United States Patent [19]

Lash

[11] 4,279,370

[45] Jul. 21, 1981

[54] DISPENSER FOR ROLLED SHEET MATERIAL

[76] Inventor: Donald W. Lash, 2450 E. Collier, Kentwood, Mich. 49506

[21] Appl. No.: 69,201

[22] Filed: Aug. 23, 1979

[51] Int. Cl.[3] ..... B26F 3/02; B65H 35/04

[52] U.S. Cl. ..... 225/67; 225/91

[58] Field of Search ..... 225/67–71, 225/91

[56] References Cited

U.S. PATENT DOCUMENTS

| | | | |
|---|---|---|---|
| 386,622 | 7/1888 | Bolton | 225/71 |
| 423,810 | 3/1890 | Rabich | 225/71 |
| 448,113 | 3/1891 | Bolton | 225/71 |
| 1,443,988 | 2/1923 | Grasberger | 225/68 X |
| 2,234,818 | 3/1941 | Bulman | 225/68 |
| 2,559,937 | 7/1951 | Bulman | 225/67 |
| 3,105,622 | 10/1963 | Waltz | 225/67 |
| 3,166,224 | 1/1965 | Waltz | 225/80 |
| 3,228,578 | 1/1966 | Waltz | 225/21 |

FOREIGN PATENT DOCUMENTS

| | | | |
|---|---|---|---|
| 450319 | 7/1936 | United Kingdom | 225/71 |
| 992279 | 5/1965 | United Kingdom . | |

*Primary Examiner*—Frank T. Yost

*Attorney, Agent, or Firm*—Blanchard, Flynn, Thiel, Boutell & Tanis

[57] ABSTRACT

A device for rotatably supporting a roll of sheet material includes a frame rotatably supporting the roll. Arms on the frame support a cutter bar parallel to the axis of the roll and movable to bear resiliently against and follow the periphery of the roll. Spacing means having a convexly rounded head is fixed on the cutter bar spaced from its cutting edge, such that the cutter bar engages the roll only by said spacing member and adjacent said cutting edge.

5 Claims, 3 Drawing Figures

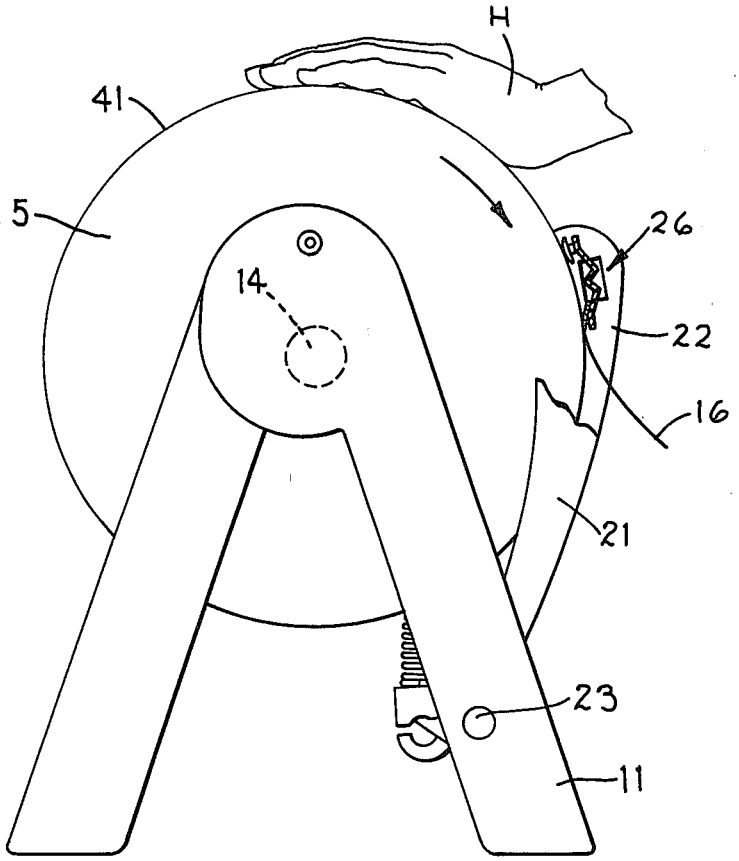
FIG. 1
FIG. 3
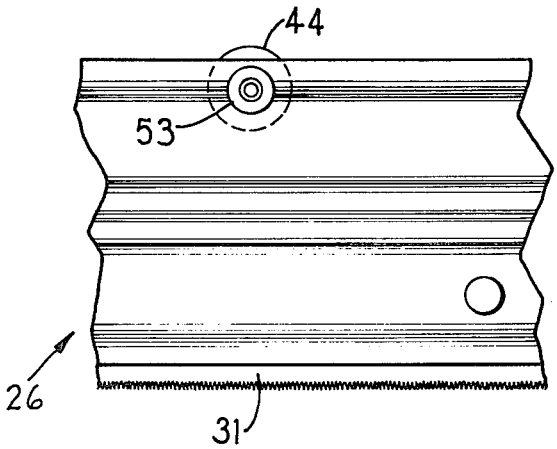
FIG. 2
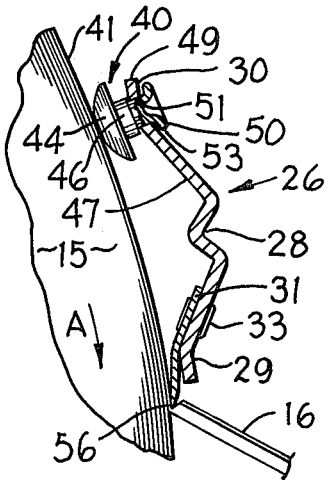

DISPENSER FOR ROLLED SHEET MATERIAL

FIELD OF THE INVENTION

This invention relates to a device for supporting a roll of sheet material and, more particularly, to a cutter bar resiliently urged toward the periphery of the roll for severing the end portion of the material from the roll.

BACKGROUND OF THE INVENTION

In known devices of this type, it is conventional for the cutter bar, which extends parallel to the axis of the roll, to be resiliently urged against the periphery of the roll and to ride thereon. The cutter bar is normally shaped transversely thereof so as to bear on the roll both at its leading, or cutting, edge and adjacent its trailing edge.

Such prior devices are widely used for cutting nonelectrically conductive materials such as paper, plastic film and the like, which are typically wound on cardboard cores. In such prior devices, the sheet material has been found to have a tendency to bunch up behind the cutting blade, as the roll is rotatably advanced by hand for exposing a previously cut edge of the sheet material preparatory to cutting a fresh piece therefrom. It is believed this may be caused by development of a static electrical charge on the sheet material as it is being wound on or unwound from the roll. Also, in such prior devices, the free end portion of the sheet material on the roll has tended to snap back against the periphery of the roll, creating difficulty in dislodging it preparatory to drawing a fresh length of material from the roll. It is believed that this "snap-back" is due to generation of a static electric charge during the unrolling of the sheet material while it is in substantial surface contact with the cutting blade, particularly with the trailing edge thereof.

SUMMARY OF THE INVENTION

It is an object of this invention to provide a sheet material dispenser device, of the type above described, in which the sheet material being led from the roll does not tend to bunch up behind the cutting blade when the roll is circumferentially advanced and wherein the leading edge of the sheet material does not tend to stick to the circumference of the roll.

Other objects and purposes of this invention will be apparent to persons acquainted with apparatus of this general type upon reading the following specification and inspecting the accompanying drawings.

The objects and purposes are met by providing a dispenser device for a roll of sheet material, which includes a cutter bar extending parallel to the axis of the roll and resiliently urged to ride the periphery of the roll. A standoff or spacing means having one or plural convexly rounded heads is fixed on the cutter bar spaced from its cutting edge and spaces the trailing edge of the cutter bar from the periphery of the roll.

BRIEF DESCRIPTION OF THE DRAWINGS

FIG. 1 is an end view of a device for dispensing pieces of sheet material from a roll, and embodying the invention.

FIG. 2 is an enlarged fragment of the device of FIG. 1 showing a cutter bar embodying the invention.

FIG. 3 is a fragmentary elevational view of the cutting blade taken from the right side of FIG. 2.

DETAILED DESCRIPTION

A sheet material dispenser device 10 comprises a frame, preferably of sheet metal, seen from one end thereof in FIG. 1. A roll support shaft, shown in dotted lines at 14, extends endwise of the frame and rotatably supports a roll 15 of sheet material, such as paper or plastic film, from which pieces, as at 16, can be cut.

Arms 21 and 22 (FIG. 1) are pivotally mounted at opposite ends of frame 11 on coaxial pivot means, generally indicated at 23. A cutter bar 26 is mounted at its ends on the free ends of the arms 21 and 22, such that the cutter bar 26 extends parallel to the axes of shaft 14 and roll 15. The pivot means 23 and cutter bar 26 are preferably located relative to the axis of roll shaft 14 such that arms 21 and 22 pivot cutter blade 26 substantially along a radius of roll 15. Arms 21 and 22 are resiliently urged, by any convenient means, to press cutter bar 26 against the periphery of roll 15. Arms 21 and 22 include portions at their free ends supporting the cutter bar 26 for limited movement, with respect thereto, sufficient to enable the cutter bar to maintain the desired engagement with the periphery of the roll even as roll diameter diminishes due to removal of sheet material therefrom.

In the embodiment shown, the cutter bar 17 has a substantially W-shaped cross section central portion 28 (FIG. 2) interconnecting leading and trailing edge portions 29 and 30. The latter are gently curved and face convexly toward the roll.

While the present invention may be applied to a wide variety of sheet material roll holding and cutting devices, the particular device above-described is of the type disclosed in British Pat. No. 982,279, granted Aug. 29, 1962.

As seen in FIGS. 2 and 3, cutter bar 26 is here provided with a toothed, or serrated, knife blade 31 which extends longitudinally along the leading edge 29 of cutter bar 26, overhangs same, and is fixed on the roll facing side of the cutter bar by any convenient means such as spot welding generally indicated at 97.

Turning now to the structure more directly concerning the present invention, a standoff member 40 extends from the surface of cutter bar 26 to slidably engage the peripheral surface 41 of roll 15. Standoff member 40 maintains the trailing edge 30 of cutter bar 26 spaced from roll surface 41. In view of the limited movement mounting of the ends of cutter bar 26 on arms 21 and 22, standoff member 40 and knife blade 31 continuously support cutter bar 26 on the peripheral surface 41 of roll 15 even as roll diameter is reduced by removal of sheet material therefrom.

To minimize surface contact between the cutter bar and roll surface 41, it is preferred that only a single standoff member 40 be provided and centered longitudinally on the cutter bar. Such standoff member 40 is narrow compared to the length of cutter bar 26. Standoff member 40 is spaced across the width of cutter bar 26 from knife blade 31, to insure proper cutting by the latter, and is preferably carried immediately adjacent the trailing edge 30 as here shown.

To avoid marring the surface of the sheet material, standoff member 40 is provided with a smoothly rounded, semispherical head 44, which maintains substantially the same engagement with the surface 41 of roll 15 even should the orientation of cutter bar 26 change with respect to the roll surface, as removal of sheet material reduces roll diameter.

In the preferred embodiment shown, the standoff member 40 is a steel rivet with a coaxial shank 46 coaxially interposed between head 106 and the roll facing surface 47 of cutter bar 26 to establish the spacing of head 44 from the cutter bar. Shank 46 is stepped at 49 to bear against the cutter bar surface 47 and to define a reduced diameter portion 50 which extends snugly through a hole 51 in cutter bar 26 and is upset at its free end 52 to fixedly secure standoff member 40 to cutter bar 26. Prior to upsetting, the end 53 of shank 107 may be of hollow cylindrical form to facilitate the upsetting process.

In operation, standoff member 40 and knife blade 31 are held by the resilient urging of arms 21 and 22 against the surface 41 of roll 15 and in turn space cutter bar 26 itself away from the roll. Applicant has found by thus holding the trailing edge 30 of the cutter bar out of contact with the roll surface 41, that dispenser operation is improved first, as the operator's hand H (FIG. 1) advances the roll in the direction of arrow A, the sheet material edge portion does not bunch up under the cutter bar 26, thereby facilitating feeding of the free edge 56 of the sheet material past the knife blade 31 so that it can be grasped by the user for pulling a fresh piece of sheet material from the roll. Further, after cutting off a piece 16 of sheet material, the sheet material edge 56 remaining on the roll does not tend to snap back against and stick to the adjacent roll surface 41, thereby again facilitating grasping of the cut off edge 56 after roll rotation by hand H brings the free edge 56 down beyond the knife blade 31.

In this way, the relatively simple addition of the standoff member 40 substantially increases the convenience of use of the dispensing device 10, and without significant increase in the cost thereof.

It may be desired to mount the frame 11 in an inverted position, as upon the lower side of a shelf, so that the roll 15 is below the frame. In such case, it would be at least desirable to mount the cutter bar 26 on the arms 21 and 22 so that the standoff member 40 (as appearing in FIG. 1) is adjacent the lower edge of the bar 26 and the knife blade 31 is along the upper edge of the bar 26. Thus, a piece of the sheet material 16 would be severed from the roll 15 thereof by an upward movement of such piece.

Although a particular preferred embodiment of the invention has been disclosed in detail for illustrative purposes, it will be recognized that variations or modification of the disclosed apparatus, including the rearrangement of parts, lie within the scope of the present invention.

The embodiments of the invention in which an exclusive property or privilege is claimed are defined as follows:

1. In a device for severing a piece of sheet material from a roll thereof, including a frame means for rotatably supporting said roll, a cutter bar having leading and trailing edges, said leading edge having sheet severing means, means movably mounting said cutter bar on said frame means substantially parallel with the axis of said roll and means resiliently urging said cutter bar toward the periphery of the roll, the improvement comprising:

a smooth surfaced standoff means fixed to the cutter bar and spaced from said severing means, said standoff means protruding from said cutter bar to bear on the periphery of the roll and hold the trailing edge of the cutter bar out of engagement with the periphery of the roll so as to allow the free end portion of the sheet material to be drawn from the roll and thereafter severed by said cutting edge, the contact area of said standoff means with the roll periphery being small compared to the surface area of the trailing edge of the cutter bar, said standoff means comprising a convexly rounded semispherical head opposing said roll for riding thereon, and means fixedly securing said head to said cutter bar to protrude from said cutter bar toward said roll.

2. The device of claim 1 in which said head spaces said trailing edge of said cutter bar from said roll while leaving said sheet severing means in contact therewith for preventing bunching up of sheet material behind said cutter bar as sheet material beneath said cutter bar is sought to be advanced by hand rotation of said roll for cutting, said standoff means comprising a rivetlike member incorporating said convexly rounded semispherical head, a shank spacing said head from the surface of the cutter bar facing said roll and a reduced diameter shank end portion extending snugly through a hole in said cutter bar and upset over the surface of said cutter bar facing away from said roll, to secure said standoff means in a rivetlike manner to said cutter bar.

3. The device of claim 1 in which said standoff means comprises plural ones of said convexly rounded heads, shank means spacing said heads from said cutter bar, said fixedly securing means securing said shank means to said cutter bar.

4. The device of claim 1 in which said standoff means is spaced intermediate the ends of said cutter bar with its head being narrower than said cutter bar is wide, said semispherical head of said standoff means making sliding contact with the periphery of said roll.

5. The device of claim 4 in which the cutter bar supports a single said standoff means centered along the length of the roll and fixed to the edge of said cutter bar opposite the severing edge.

* * * * *